US006174049B1

(12) United States Patent
Tachihara et al.

(10) Patent No.: US 6,174,049 B1
(45) **Date of Patent: *Jan. 16, 2001**

(54) BUBBLE JET HEAD AND BUBBLE JET APPARATUS EMPLOYING THE SAME

(75) Inventors: Masayoshi Tachihara, Chofu; Yasuyuki Tamura, Yokohama; Mineo Kaneko; Makoto Shioya, both of Tokyo, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/902,942

(22) Filed: Jul. 30, 1997

(30) Foreign Application Priority Data

Jul. 31, 1996 (JP) ..... 8-200865

(51) Int. Cl.[7] ..... B41J 2/05
(52) U.S. Cl. ..... 347/65; 347/92
(58) Field of Search ..... 347/65, 63, 67, 347/92, 94

(56) References Cited

U.S. PATENT DOCUMENTS

| | | | |
|---|---|---|---|
| 4,611,219 | 9/1986 | Sugitani et al. | 346/140 R |
| 5,132,707 | 7/1992 | O'Neill | 346/140 R |
| 5,159,354 | 10/1992 | Hirasawa et al. | 346/140 R |
| 5,164,747 | 11/1992 | Osada et al. | 346/140 R |
| 5,343,227 | 8/1994 | Hirosawa et al. | 349/42 |
| 5,574,488 | 11/1996 | Tamura | 347/63 |
| 5,635,966 * | 6/1997 | Keefe et al. | 347/65 |
| 5,793,393 * | 8/1998 | Coven | 347/65 |

FOREIGN PATENT DOCUMENTS

| | | |
|---|---|---|
| 195 05 465 | 8/1995 | (DE) . |
| 0 549 211 | 6/1993 | (EP) . |
| 0 568 247 | 11/1993 | (EP) . |
| 0 641 654 | 3/1995 | (EP) . |
| 0 691 204 | 1/1996 | (EP) . |
| 0 694 398 | 1/1996 | (EP) . |
| 1-087356 | 3/1989 | (JP) . |
| 1-152068 | 6/1989 | (JP) . |
| 5-16365 | 1/1993 | (JP) . |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

Each of branched ink supply passages 42*ai* to 42*an* and 42*bi* to 42*bn* in a driving substrates 32 is constituted of a parallel passage portion 46*a* and a narrow passage portion 48*a*. An ink from an ink supply opening 32*a* is supplied to a receptacle portions 50 respectively receiving heater portions 32*ai* to 32*an* and 32*bi* to 32*bn* via the branched ink supply passages 42*ai* to 42*an* and 42*bi* to 42*bn*.

8 Claims, 7 Drawing Sheets

BUBBLE JET HEAD AND BUBBLE JET APPARATUS EMPLOYING THE SAME

BACKGROUND OF THE INVENTION

1. Field of the Invention

The present invention relates to a bubble jet head arranged in opposition to a printing surface of a printing medium for ejecting an ink toward the printing surface by a pressure of a bubble, and an bubble jet apparatus employing such bubble jet head.

2. Description of the Related Art

In a bubble jet head, there are an edge shooter type and a side shooter type, in general. In the edge shooter type bubble jet head, ink ejection openings are provided on an edge portion as downstream portion with respect to heater portions as ink heating portions provided for respective of a plurality of branched ink passages for delivering an ink from an ink storage portion. On the other hand, in the side shooter type bubble jet head, the ink ejection openings are provided in opposition to the heater portions provided for respective of a plurality of the branched ink passages.

In the side shooter type bubble jet head, high work efficiency of an electrical energy to be supplied to the heater portion is achieved for relatively short distance between the ejection opening forming surface and heating surfaces of the heater portions. On the other hand, the side shooter type bubble jet head is advantageous in that even when it is left for a while without being actuated and then printing operation is resumed in such condition, possibility of ejection failure incapable of ejecting ink droplet for increased viscosity of the ink due to evaporation of volatile component contained in the ink, can be significantly reduced.

In the side shooter type bubble jet head, as disclosed in Japanese Patent Application Laid-open No. 152068/1989, for example, there has been proposed one, in which the heater portion is disposed within a receptacle portion, one end of which is opened to an ink supply passage, and surrounded in order to reduce vibration of meniscus upon ejection of the ink and not to interfere ejection of the ink droplet, and a narrow passage portion (in the publication, it is referred to as "local restricting portion") is provided between a portion in the vicinity of an opening portion of a common ink supply passage and ends of respective ink supply passages.

On the other hand, as shown in Japanese Patent Application Laid-open No. 16365/1993, for example, there has been proposed one, in which bubble in expanded condition as heated by a heating surface of the heater portion is communicated with atmosphere in the vicinity of the ink ejection opening, and the ink covering the bubble and the ink in the vicinity of the ink ejection opening are continuous without being blocked by the bubble, so as to be employed in the side shooter type bubble jet head to efficiently eject relatively small ink droplet without spraying.

In such bubble jet head, for speeding up the printing operation, it becomes important to shorten a period for refilling of ink, as important factor for setting a driving frequency.

However, as in the foregoing example, when the heater portion is arranged within the receptacle portion and surrounded therein, and the descending cross sectional area passage portion (narrow passage portion) is provided between the opening portion of the common ink supply passage and the ends of respective ink supply passages, it is possible to increase flow resistance due to presence of the narrow passage portion. Thus, limitation should be caused in shortening of refilling period of the ink. On the other hand, upon high speed printing, residual bubble in the ink which should cause adverse effect of ejection speed of the ink droplet and ejecting direction of the ink droplet, can be retained within the ink supply passage due to presence of the narrow passage portion.

On the other hand, as noted above, when the bubble in the expanded condition as heated by the heating surface of the heater portion is communicated to the atmosphere in the vicinity of the ink ejection opening, and the ink covering the bubble and the ink in the vicinity of the ink ejection opening are continuous without being blocked by the bubble, since meniscus which becomes relatively large (after ejection of ink droplet (after cutting the ink droplet)) is caused, it becomes particularly necessary to reduce flow resistance. Therefore, influence of the narrow passage portion for the refilling period of the ink is significant.

SUMMARY OF THE INVENTION

In consideration of the above, it is an object of the present invention to provide a bubble jet head arranged in opposition to a printing surface of a printing medium for ejecting an ink toward the printing surface by a pressure of a bubble within the ink, and an bubble jet apparatus employing such bubble jet head, wherein a refilling period of the ink can be sufficiently shortened to permit speeding up of printing operation, and retention of residual bubble in the ink with in an ink supply passage can be avoided to enable stable ink ejecting operation.

In order to achieve the above object, there is provided a bubble jet head comprising:

a common ink supply passage having ink supply opening in one end portion and introducing an ink supplied from an ink storage portion through the ink supply opening;

branched ink supply passages, each having an opening end portion communicated with the ink supply opening of the common ink supply passage and supplying the ink to an ink heating portion via the opening end portion; and an ink ejection opening forming surface arranged in opposition to the ink heating portion with a predetermined distance and having ink ejection openings for ejecting ink droplet formed by heating the ink supplied through the branched ink supply passages in the ink heating portion, the branched ink supply passage has a region which a width of section of the branched ink supply passage in a direction perpendicular to a direction from the opening portion to the ink ejection opening in the branched ink passage is gradually narrowed from the opening end portion to the ink heating portion.

There is provided an bubble jet apparatus comprising:

a printing portion arranged in opposition to a printing surface of a printing medium, has having a head carrying portion selectively loaded the above bubble jet head;

a driving portion moving the printing portion along the printing surface of the printing medium;

a printing operation control portion for making the bubble jet head to perform printing operation.

As can be appreciated from the above, with the bubble jet head according to the present invention and the bubble jet apparatus employing the bubble jet head, since the width of section of the branched ink supply passage in a direction perpendicular to a direction from the opening end portion to the ink ejection opening, in the branched ink supply passage is gradually reduced from the opening end portion toward the ink heating portion, capillary effect in the vicinity of the ink heating portion is promoted to sufficiently shorten the refilling period of the ink to permit high speed printing operation. Also, retention of the residual bubble in the ink within the ink supply passage can be successfully avoided to stabilize ink ejecting operation.

On the other hand, in the case where the ink heating portion is surrounded by the wall portion of the receptacle portion formed continuously with the wall portion forming the circumferential edge portion of the branched supply passage, vibration of the ink ejection opening forming surface by the bubble generated in the ink can be restricted.

Furthermore, when the bubble formed in the ink is in the expanded state as heated by the ink heating portion, the bubble is in communication with the atmosphere in the vicinity of the ink ejection opening. Also, since the ink covering the bubble and the ink in the vicinity of the ink ejection opening are continuous, when the ink is ejected, ejection amount and the ejection speed can be stabilized without causing splash of the ink in the vicinity of the ink ejection opening.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 5:
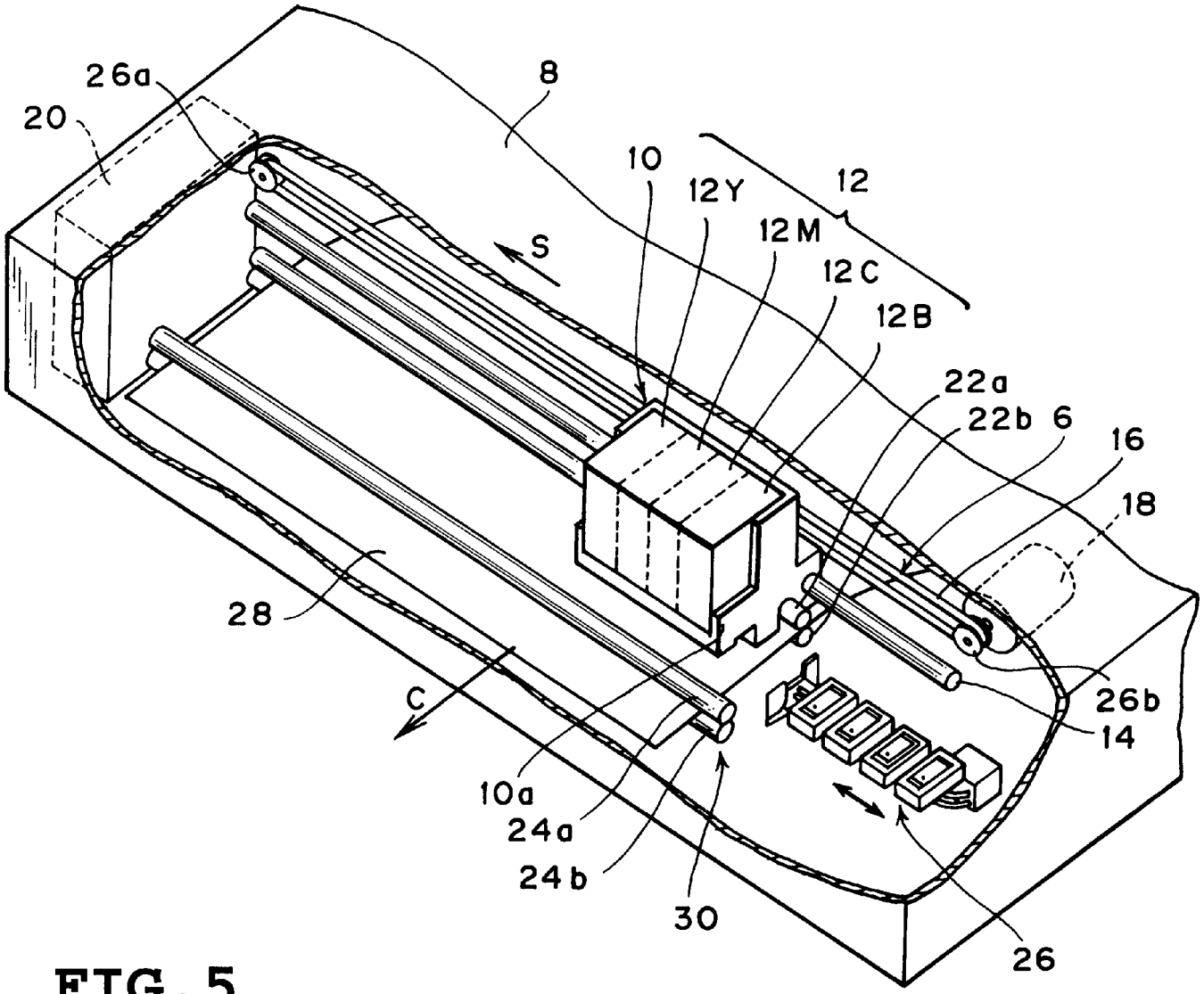
FIG. 5 is a general perspective view of the major portion of an bubble jet apparatus employing the bubble jet head according to the present invention.

FIG. 5 generally shows one example of a bubble jet head according to the present invention, and one example of the major part of an bubble jet apparatus employing such bubble jet head.

In FIG. 51 the bubble jet apparatus is constructed with a transporting device 30 intermittently transporting a paper 28 as a printing medium provided along longitudinal direction within a casing 8 in a direction of arrow C shown in FIG. 5, a printing portion 10 reciprocating substantially in parallel to a direction perpendicular to the transporting direction of the paper 28 by the transporting device 30, and a printing portion driving portion 6 as driving means for reciprocally moving the printing portion 10.

The transporting device 30 includes a pair of roller units 22*a* and 22*b* arranged in opposition to each other in substantially parallel relationship to each other, a pair of roller units 24*a* and 24*b*, and a driving portion 20 for driving the roller units 22*a*, 22*b* and 24*a*, 24*b*. By this, when the driving portion 20 is placed in operating condition, the paper 28 is transmitted intermittently as gripped between the roller units 22*a* and 22*b* and the roller units 24*a* and 24*b*.

The printing portion driving portion 6 is constructed with a belt 16 stretched between pulleys 26*a* and 26*b* arranged on rotary shafts arranged in opposition with a predetermined interval, a guide shaft 14 guiding movement of a carriage member 10*a* of the printing portion 10 arranged substantially in parallel with respect to the roller units 22*a* and 22*b*, and a motor 18 driving the belt 16 connected to the carriage member 10*a* of the printing portion 10 in forward and reverse directions.

When the motor 18 is placed in driving condition to circulate the belt 16 in the direction shown by arrow S in FIG. 5, the carriage member 10*a* of the printing portion 10 is shifted in a predetermined shifting amount in the same direction. On the other hand, when the motor 18 is placed in driving condition to circulate the belt 16 in the direction opposite to the direction shown by arrow S in FIG. 5, the carriage member 10*a* of the printing portion 10 is shifted in a predetermined shifting amount in the direction opposite to the direction shown by arrow S in FIG. 5. Also, on one end portion of the printing portion driving portion 6, a recovery unit 26 for performing ejection recovery process of the printing portion 10 is provided at the position to be a home position of the carriage member 10*a*, in opposition to the ink ejection opening array.

The printing portion 10 is provided with bubble jet heads 12Y, 12M, 12C and 12B for respective colors of yellow, magenta, cyan and black, for example. On the other hand, ink tanks supplying respective color of inks to respective bubble jet heads 12Y, 12M, 12C and 12B are detachably mounted on the carriage member 10*a* of the printing portion 10.

The bubble jet heads 12Y, 12M, 12C and 12B have mutually the same construction. Therefore, the following description will be given with respect to the bubble jet head 12Y, and description for other bubble jet heads 12M, 12C and 12B will be neglected for keeping the disclosure simple enough to facilitate clear understanding of the present invention.

Figure 4:
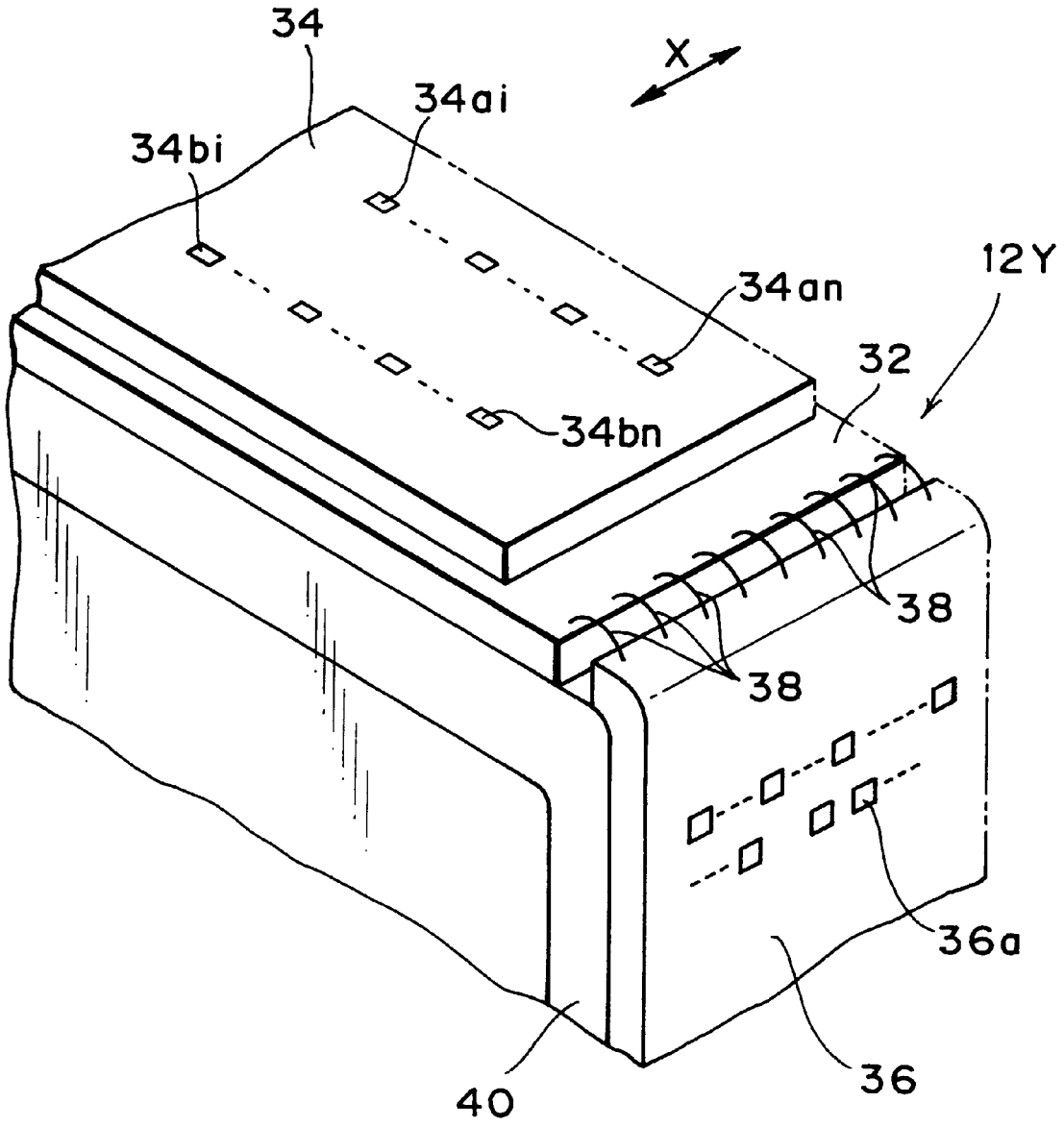
FIG. 4 is an enlarged perspective view showing one example of the bubble jet head according to the present invention.

The bubble jet head 12Y is constructed with a driving substrate 32 fixed to a sub ink tank 40 as an ink storage portion, an orifice plate member 34 as an ink ejection opening forming surface fixed on the driving substrate 32, and an electrode plate member 36 electrically connected to the driving substrate 32 by a wire group 38 as shown in FIG. 4. The bubble jet head 12Y performs printing with maximum 8000 pixels per one second and thus, a scanning speed is set at 338.8 (mm/s), for example.

The electrode plate member 36 is provided with a plurality of electrode portions 36*a* electrically connected to respective electrode portions of the printing portion 10 when the bubble jet head 12Y is set in the printing portion 10.

On the orifice plate member 34, n in number of ink ejection openings 34*ai*, . . . , 34*an*, and 34*bi*, . . . 34*bn* (i=1 to n) are respectively arranged with a predetermined interval in mutually parallel two arrays along a direction substantially perpendicular to a direction shown by arrow X in FIG. 4, namely to scanning direction X. On the other hand, the ejection openings 34*ai*, . . . , 34*an* and 34*bi* . . . 34*bn* are opposed with an offset of 84.7/2 (μm) in the alignment direction so that each individual ink ejection opening in one array of the ink ejection openings is located at intermediate position between two adjacent ink ejection openings in the other array of ink ejection openings. Namely, the ink ejection openings in two arrays are arranged in checkered fashion. The shapes of each ink ejection opening 34*ai* and 34*bi* is in a rectangular shape of 20 (μm) in the shorter side along the scanning direction and 21 (μm) in the longer width, for example.

Figure 2:
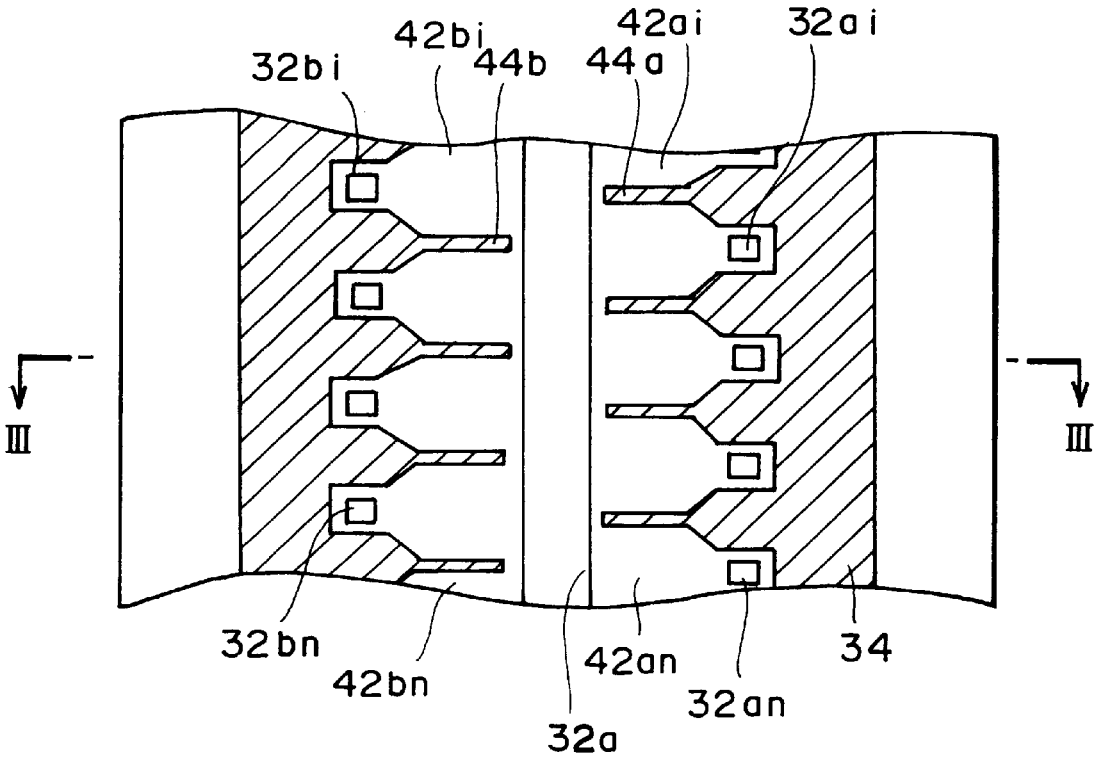
FIG. 2 is an enlarged section view showing one example of the major part of the bubble jet head according to the present invention.
Figure 3:
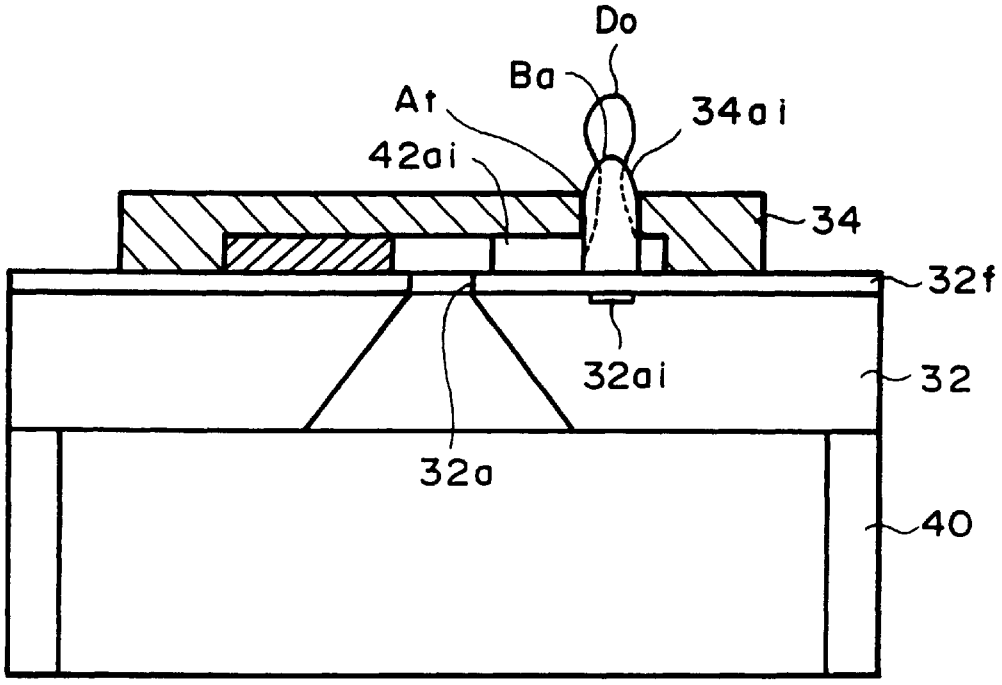
FIG. 3 is a section view taken along line III—III in the example shown in FIG. 2.

The driving substrate 32 is formed of silicon, for example. As shown in FIGS. 2 and 3, an ink supply openings 32*a*, opening in tapered form are provided within a sub ink tank 40 at a position between the array of n in number of the ink ejection openings 34*ai* to 34*an* and the array of n in number of ink ejection openings 34*bi* and 34*bn*, along the alignment direction of the array of the ink ejection openings 34*ai* to 34*an*. The ink supply opening 32*a* may be formed by anisotropic etching, for example. Over the entire surface in the driving substrate 32, on which the orifice plate member 34 is fixed, a protective film 32*f* of silicon nitride (SiN) is formed, for example. The protective film 32 is in a thickness of 0.6 (μm), for example.

On the surface of the driving substrate 32 covered with the protective film 32*f* as shown in FIG. 2, heater portions 32*ai* to 32*an* and 32*bi* to 32*bn* (i=1 to n, n is an integer) are provided with a predetermined pitch, e.g. 84.7 (μm) pitch, at positions respectively opposing to respective of n in number of ink ejection openings 34*ai*, . . . , 34*an* and 34*bi*, . . . , 34*bn* on the orifice plate member 34. In respective heater portions 32*ai* to 32*an* and 32*bi* to 32*bn*, branched ink supply passages 42*ai* to 42*an* and 42*bi* to 42*bn* for delivering ink supplied through the ink supply opening 32*a* to respective heater portions 32*ai* to 32*an* and 32*bi* to 32*bn*, are symmetrically arranged in opposition across the ink supply opening 32*a*.

As the branched ink supply passages 42*ai* to 42*an* and 42*bi* to 42*bn* are respectively have the same structure, only one branched ink supply passage 42*ai* among the branched ink supply passages 42*ai* to 42*an* and 42*bi* to 42*bn*, will be explained, and description for other branched ink supply passages will be neglected.

Figure 1:
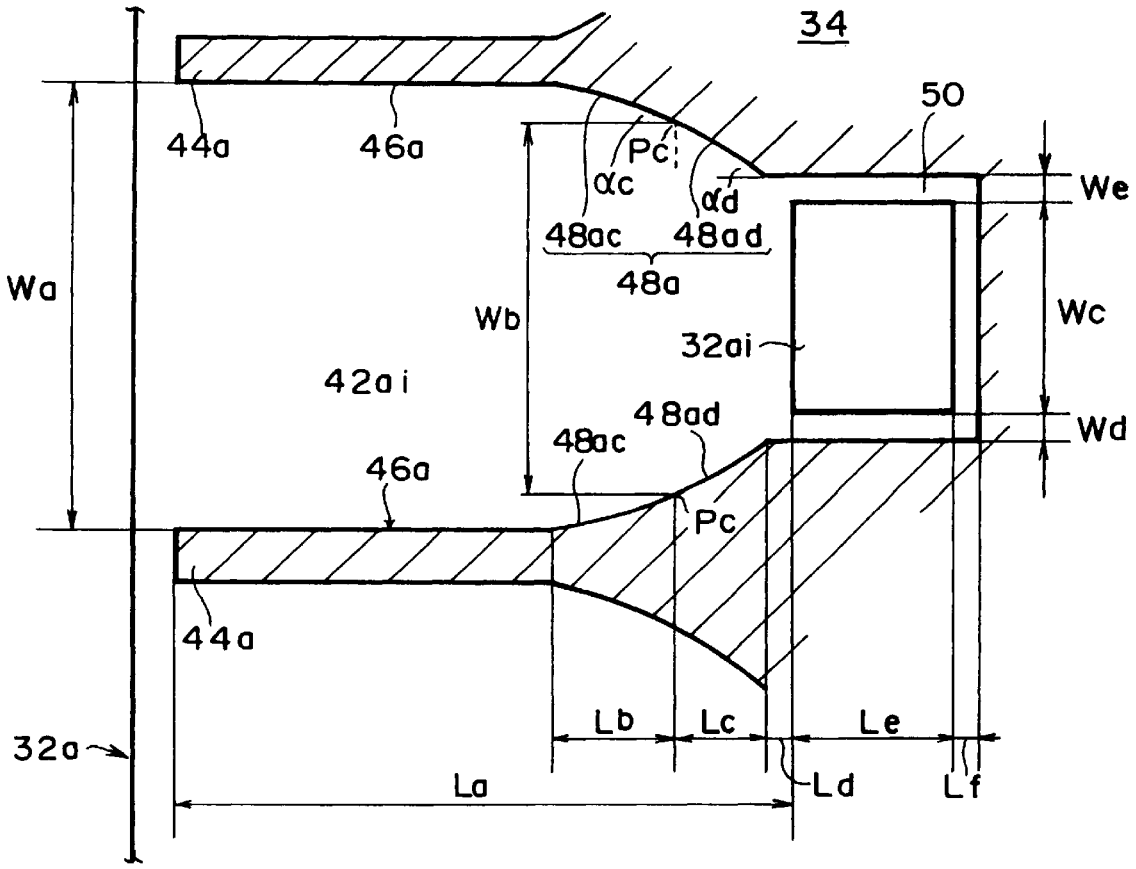
FIG. 1 is an enlarged section view showing one example of a major part of a bubble jet head according to the present invention.

As shown in enlarged form in FIG. 1, the branched ink supply passage 42*ai* is defined between a pair of partitioning walls 44*a* separating respective branched ink supply passages. The branched ink supply passage 42*ai* is constructed with a constant cross sectional area passage portion (parallel passage portion) 46*a* having an opening end portion opening on the side of the ink supply opening 32*a* at one end and a contracted passage portion 48*a* continuous with the parallel passage portion 46*a*. On the other end of the branched ink supply passage 42*ai*, a receptacle portion 50 for receiving the heater portion 32*ai* is provided.

A width Wa of the parallel passage portion 46*a* in the branched ink supply passage 42*ai* is assumed to be 72 (μm), for example. The contracted passage portion 48*a* is consist of two contracted portions 48*ac* and 48*ad* having mutually different gradients are joined at a joint Pc. One end of the contracted portion 48*ac* is joined with the parallel passage portion 46*a*, and the other end of the contracted portion 48*ad* is joined with the receptacle portion 50.

A length Lb from the end portion of the parallel passage portion 46*a* to the joint Pc and gradient symbol αc in the contracted portion 48*ac* are 20 (μm) and about 16.7° [$\tan^{-1}$(6/20)], for example. On the other hand, a length Lc from the joint Pc to the end portion and gradient symbol αd in the contracted portion 48*ad* are 14 (μm) and about 29.7° [$\tan^{-1}$(8.0/14)]. It is desirable to set the gradient in the contracted portion 48*ad* within a range of about 10° to 30°.

A refill period of the ink depends on capillary force determined by curvature radius of meniscus and surface tension of the ink. The capillary force becomes greater at smaller curvature radius of the meniscus. Therefore, the capillary force becomes greater, when the width of the ink supply passage in the vicinity of the heater portion 32*ai* is made smaller.

The reason why the contracted passage portion 48*a* is widened toward the parallel passage portion 46*a* from the joint Pc, is to facilitate discharging on the side of the ink ejection opening without retaining the residual bubble in the ink. On the other hand, since the contracted passage portion 48*a* is gradually widened toward the parallel passage portion 46*a*, generation of swirl to be a cause of the residual bubble can be restricted.

Furthermore, it order to certainly avoid retention of the residual bubble in the ink, a boundary portion between the joint Pc, the contracted portion 48*a* and the parallel passage portion 46*a* and a boundary portion between the contracted portion 48*a* and the receptacle portion 50 respectively may be rounded with a predetermined curvature (arc portion).

The heater portion 32*ai* is formed into a rectangular shape consisted of a predetermined shorter edge and longer edge. Dimensions of the shorter edge and the longer edge Le and Wc are respectively 26 (μm) and 36 (μm), for example. The center position of the heater portion 32*ai* is substantially match with the center position of the ink ejection opening 34*ai*. The heater portion 32*ai* is received within the receptacle portion 50 so that a distance La from the opening end portion of the branched ink supply passage 42*ai* to the opposing one edge of the branched ink supply passage 42*ai* is 100 (μm), for example.

The receptacle portion 50 is defined by wall portion surrounding three edges of the heater portion 32*ai* with a predetermined clearance. Distances Lf, Wd and Wd between respective edges of the heater portion 32*ai* and the wall portion are respectively 4 (μm) at the maximum. On the other hand, a distance Ld between the end portion of the contracted portion 48*a* and one edge of the heater portion 32*ai* is 4 (μm).

In the expanded condition of the bubble Ba owing to film boiling in the ink in the vicinity of the heater portion 32*ai*, while ink ejection, vibration of the orifice plate member 34 can be avoided, because the receptacle portion 50 is formed to surround three edges of the heater portion 32*ai* by the wall portions with the predetermined gap.

In addition, in one embodiment of the bubble jet apparatus according to the present invention, while not illustrated in the drawings, a printing operation control portion for controlling printing operation of the bubble jet head is provided. The printing operation control portion generates a driving control pulse signal on the basis of a binary data derived from a printing data indicative of an image to be printed on a paper 28 through predetermined image processing, and supplies the driving control pulse signal to the bubble jet head at a predetermined timing.

In the construction as set forth above, while the predetermined amount of ink is supplied to the receptacle portion 50 at the predetermined timing through the ink supply opening 32*a* and the branched ink supply passage 42*ai*, when the printing portion 10 is moved in the scanning direction, the driving control pulse signal from the printing operation control portion is supplied to respective heater portion 32*ai* to cause expanded condition of the bubble Ba by film boiling in the vicinity of the heater portion 32*ai* to push up the ink toward the ink ejection opening 34*ai*. It has been confirmed by the inventors through experiments, that at this time, the bubble Ba will be communicated with the atmosphere from the outer side peripheral portion to the portion At in the vicinity of the inner side of the ink ejection opening 34*ai*, as shown in FIG. 3., and the portion of the ink droplet Do other than that located in the portion At in the vicinity of the inner side of the ink ejection opening 34*ai* is continuous with the ink within the branched ink supply passage 42*ai*. By this, stable ejection is performed against the surface of the paper 28 without causing splashing of the ink.

On the other hand, it has also been confirmed by the inventor through experiments, that, when the pulse width of the driving control pulse signal and the driving voltage are respectively 2.5 (μs) and 13V, the ejection volume of the ink and the flying speed of the ink, and the refilling period (a period from a timing of initiation of application of the driving control pulse signal to the heater portion 32*ai* to completion of refilling of the ink are respectively $8.4\times10^{-9}$ $cm^3$, 15.9 (m/s) and 95 (μs). It should be noted that the ink employed in the experiments has the following composition.

| | |
|---|---|
| Tiodiglycol | 5% |
| Glycerin | 5% |
| Urea | 5% |
| Isopropyl alcohol | 4% |
| Acetylenol solution | 0.1% |
| Water | Remainder |

Figure 6:
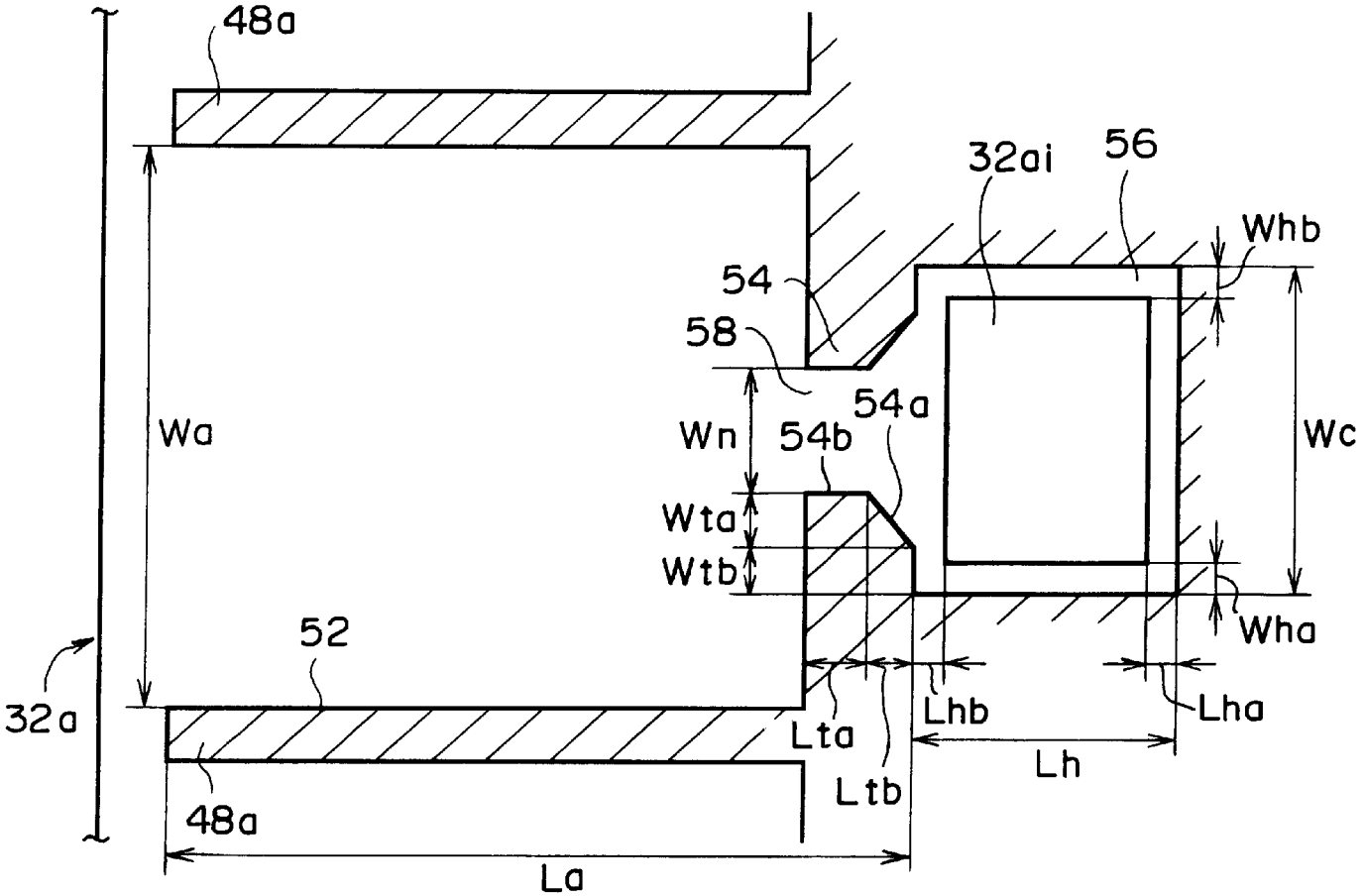
FIG. 6 is an enlarged section view showing the major part of a branched ink supply passage of a driving substrate in a comparative example.

On the other hand, a comparative example is shown in FIG. 6. In FIG. 6, one of a plurality of branched ink supply passages 52 and a receptacle portions 56 arranged on both sides of the ink supply opening 32*a* in checkered fashion, are illustrated in enlarged form. It should be noted that the heater portion 32*ai*, the orifice plate 34 and the sub ink tank 40 are the same as those in the former embodiment.

The branched ink supply passage 52 is defined by substantially parallel partitioning wall portions 48*a* arranged in opposition with a predetermined interval Wa, e.g. 72 (μm). The receptacle portion 56 receiving the heater portion 32*ai* is communicated with the branched ink passage 52 via a narrow passage portion 58.

The receptacle portion 56 is defined by the wall portion surrounding three edges of the heater portion 32*ai*, for example. The length Lh of the wall portion along the shorter edge of the heater portion 32*ai* and the length Wc along the longer edge of the heater portion 32*ai* in the receptacle portion 56 are respectively 34 and 44 (μm).

On the other hand, the heater portion 32*ai* is arranged with predetermined distances Wha, Whb, Lha and Lhb, e.g. 4 (μm) respectively, from the wall surface of the receptacle portion 56. Also, a position on one edge opposing to the branched ink supply passage in the heater portion 32*ai* is located at a position located at a predetermined distance La from the opening end portion of the branched ink supply passage 52, e.g. 100 (μm).

The narrow passage portion 58 includes a tapered surface portion 54*a* opposing to the receptacle portion 56 and a parallel passage portion 54*b*.

The tapered surface portion 54*a* is provided with a predetermined gradient $\tan^{-1}$ (Wta/Ltb), for example $\tan^{-1}$ (7/6). On the other hand, a step Wtb between the tapered surface portion 54*a* and the receptacle portion 56 is 6.5 (μm). The diameter Wn and length Lta of the parallel passage portion 54*b* are respectively 17 and 8 (μm), respectively. In the construction set forth above, it has been confirmed by the inventor through experiments that, when the pulse width of the driving control pulse signal and the driving voltage are 2.5 (μs) and 13V, similarly to the foregoing example, the ink ejection volume, the ink flying speed and the refilling period are respectively $8.4\times10^{-9}$ ($cm^3$), 16.6 (m/s) and 140 (μs). Therefore, the refilling period in the comparative example is slower than the refilling period in the above embodiment of the present invention.

Figure 7:
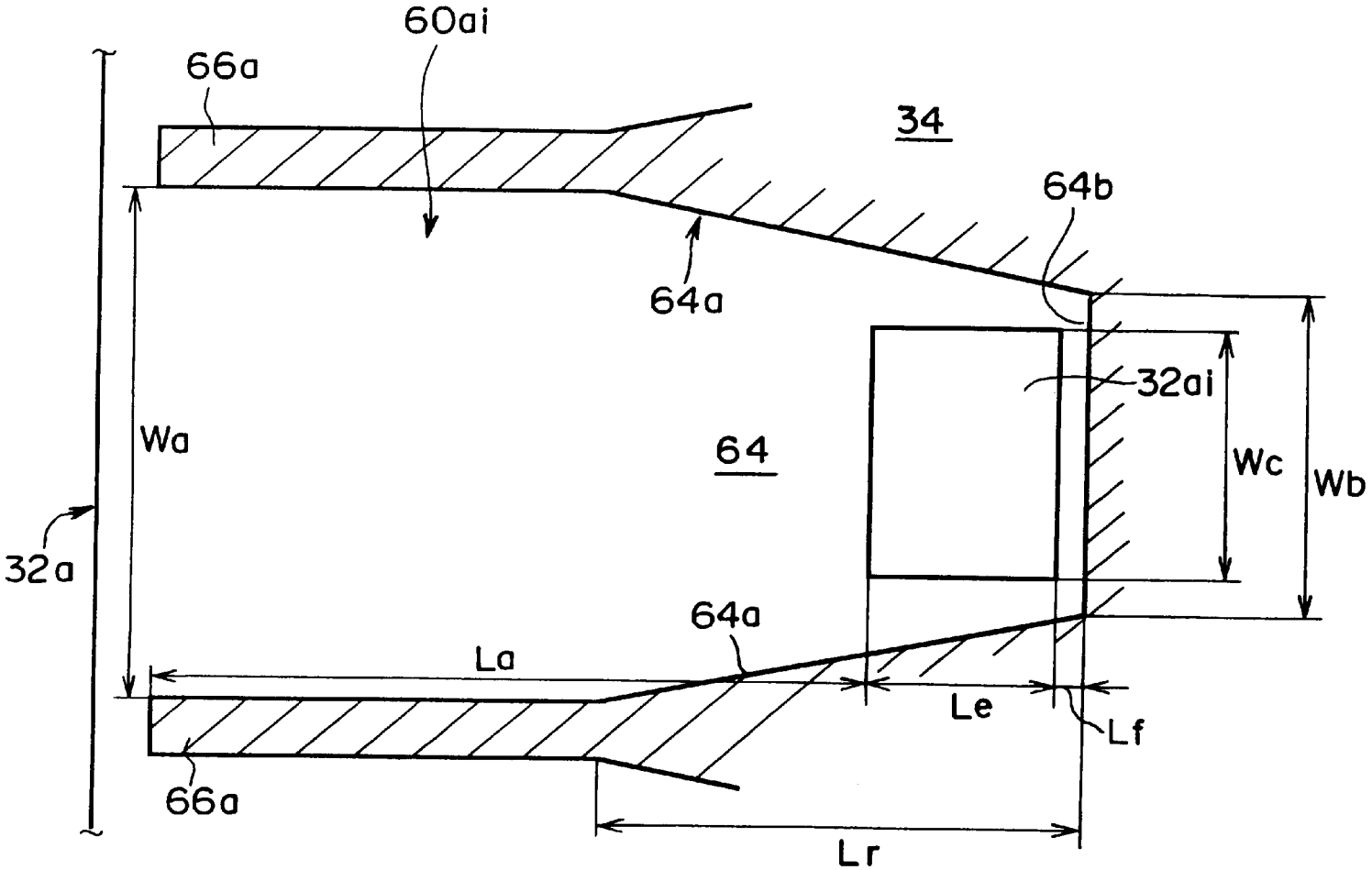
FIG. 7 is an enlarged perspective view showing the major part of another embodiment of the bubble jet head according to the present invention.

FIG. 7 shows another example of the bubble jet head according to the present invention.

As set forth above, in the embodiment shown in FIG. 1, each branched ink supply passages 42*ai* to 42*an* is constituted of the parallel passage portion 46*a* and the narrow passage portion 48*a*, and the ink is supplied to the receptacle portion 50 receiving the heater portion 32*ai* via the branched ink supply passage 42*ai*. In contrast to this, in the embodiment shown in FIG. 7, branched ink supply passages 60*ai* to 60*an* and 60*bi* to 60*bn* (i=1 to n, n is integer) provided symmetrically with respect to the ink supply passage 32*a* are constructed with parallel passage portions. On the other hand, a receptacle portion 64 receiving the heater portion 32*ai* which has the same construction with the former embodiments, is widened toward the end of the parallel passage portion for communication.

In FIG. 7, one of a plurality of the branched ink supply passages 60*ai* to 60*an* and the receptacle portions 64 is illustrated in enlarged form.

The branched ink supply passage 60*ai* is defined by partitioning wall portions 66*a* separating adjacent branched ink supply passages as arranged substantially in parallel to each other in opposition. The width Wa of the parallel passage portion in the branched ink supply passage 60*ai* is 72 (μm), for example.

The receptacle portion 64 is defined by a tapered wall portion 64*a* connected to the parallel passage portion of the branched ink supply passage 60*ai* and the wall portion 64*b* opposing to the opening end of the parallel passage portion of the branched ink supply passage 60*ai*. The wall portion 64*a* has the predetermined gradient [$\tan^{-1}$ (14/68)] with respect to the parallel passage portion, the predetermined length Lr, e.g. 68 (μm). One end of the wall portion 64*a* is connected by the wall portion 64*b*. The width Wb of the wall portion 64*b* is 44 (μm), for example. The heater portion 32*ai* is arranged at substantially center position with predetermined distance Lf e.g. 4 (μm) from the wall portion 64*b* in the receptacle portion 64. On the other hand, the position of one edge opposing to the branched ink supply passage 60*ai* in the heater portion 32*ai* is positioned with a predetermined distance La from the opening end portion of the parallel passage portion, e.g. 100 (μm).

With such construction, it has also been confirmed by the inventor through experiments, that, when the pulse width of the driving control pulse signal and the driving voltage are respectively 2.5 (μs) and 13V similarly to the foregoing example, the ejection volume of the ink and the flying speed of the ink, and the re filling period (a period from a timing of initiation of application of the driving control pulse signal to the heater portion 32*ai* to completion of refilling of the ink are respectively $8.3\times10^{-9}$ ($cm^3$), 15.6 (m/s) and 88 (μs).

Accordingly, even in the shown embodiment, similarly to the former embodiment, refilling period can be shortened in comparison with the comparative example, and thus can obtain the similar effect to the former embodiment.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A bubble jet head comprising:

a common ink supply passage having an ink supply opening in one end portion and introducing an ink supplied from an ink storage portion through said ink supply opening;

a plurality of branched ink supply passages, each having an opening end portion communicating with said ink supply opening of said common ink supply passage and supplying the ink to an ink heating portion via said opening end portion; and an ink ejection opening forming surface arranged in opposition to said ink heating portion with a predetermined distance therebetween and having a plurality of ink ejection openings for ejecting ink droplet formed by heating the ink supplied through said branched ink supply passages in said ink heating portion, wherein said branched ink supply passage has a parallel passage portion and a section having a width, the width of the section of said branched ink supply passage being in a direction perpendicular to a direction from the opening end portion to said ink ejection opening in said branched ink supply passage, a uniform passage portion having the width that is uniform along the direction, and the contracted portion that is formed between said ink ejection opening and said uniform passage portion, said contracted portion beiing such that said width is gradually narrowed toward said ejection opening.

2. A bubble jet head as claimed in claim 1, wherein said ink heating portion is surrounded by wall portion of an ink heating portion receptacle portion.

3. A bubble jet head as in claim 1, wherein said width of a portion in said branched ink supply passage in which said ink heating portion is provided is gradually narrowed along the direction.

4. A bubble jet head as in claim 1, wherein a plurality of said branched ink supply passages are arranged along both sides of said ink supply opening in said common ink supply passage for forming arrays.

5. A bubble jet head as in claim 1, wherein when bubble formed within the ink by heating in said ink heating portion is in expanded condition, the bubble is in communication with the atmosphere in a vicinity of said ink ejection opening, and the ink covering the bubble is continuous with the ink in the vicinity of said ink ejection opening.

6. An bubble jet apparatus comprising:

a printing portion arranged in opposition to a printing surface of a printing medium, having a head carrying portion selectively loaded a bubble jet head defined in claim 1;

a driving portion moving said printing portion along said printing surface of said printing medium; and a printing operation control portion for making said bubble jet head to perform printing operation.

7. A bubble jet head as in claim 1, wherein said width of a portion in said branched ink supply passage in which said ink heating portion is provided is uniform along the direction.

8. A bubble jet head as in claim 1, wherein said ink heating portion comprises a heat generating resistor.

* * * * *

UNITED STATES PATENT AND TRADEMARK OFFICE

CERTIFICATE OF CORRECTION

PATENT NO. : 6,174,049 B1
DATED : January 16, 2001
INVENTOR(S) : Masayoshi Tachihara et al.

It is certified that error appears in the above-identified patent and that said Letters Patent is hereby corrected as shown below:

Title page,
Item [57], ABSTRACT, line 2, "substrates" should read -- substrate --.

Column 1,
Line 9, "an" should read -- a --; and "such" should read -- such a --;
Line 48, "bubble" should read -- a bubble --;
Line 58, "as" should read -- as an --; and
Line 63, "cross sectional" should read -- cross-sectional --.

Column 2,
Line 25, "an" should read -- a --; and "such" should read -- such a --;
Line 28, "with in" should read -- within --;
Line 45, "ink" should read -- an ink --;
Line 54, "an" should read -- a --;
Line 56, "has having" should read -- having --;
Line 57, "loaded" should read -- loaded with --; and
Line 61, "medium;" should read -- medium; and --.

Column 3,
Line 43, "an" should read -- a --;
Line 57, "an" should read -- a --; and "such" should read -- such a --; and
Line 61, "along" should read -- along the --.

Column 4,
Lines 2, 18, and 22, "in" should read -- in a --;
Line 6, "in" should read -- in an --; and
Line 36, "color" should read -- colors --.

Column 5,
Line 12, "an" should be deleted;
Line 46, "cross sectional" should read -- cross-sectional --; and
Line 56, "is consist" should read -- consisting --.

Column 6,
Line 3, "on" should read -- on a --;
Line 4, "by" should read -- by the --; and
Line 35, "by" should read -- by the --.

Column 7,
Line 7, "FIG. 3.," should read -- FIG. 3, --.

UNITED STATES PATENT AND TRADEMARK OFFICE

CERTIFICATE OF CORRECTION

PATENT NO. : 6,174,049 B1
DATED : January 16, 2001
INVENTOR(S) : Masayoshi Tachihara et al.

It is certified that error appears in the above-identified patent and that said Letters Patent is hereby corrected as shown below:

Column 8,
Line 2, "respectively" should be deleted;
Line 29, "is" should read -- are --;
Line 60, "re filling" should read -- refilling --; and
Line 67, "obtain" should read -- be obtained --.

Column 9,
Line 12, "in one end portion" should be deleted;
Line 23, "ink droplet" should read -- an ink droplet --;
Line 26, "a parallel" should be deleted;
Line 27, "passage portion and" should be deleted; and
Line 35, "beiing" should read -- being --.

Column 10,
Line 3, "by" should read -- by a --;
Line 13, "bubble" should read -- a bubble --;
Line 15, "in" should read -- in an --;
Line 19, "An" should read -- A --;
Line 22, "loaded" should read -- loaded with --; and
Line 27, "printing" should read -- a printing --.

Signed and Sealed this

Twenty-third Day of April, 2002

*Attest:*

*Attesting Officer*

JAMES E. ROGAN
*Director of the United States Patent and Trademark Office*